US005649350A

United States Patent [19]

Lampe et al.

[11] Patent Number: 5,649,350

[45] Date of Patent: Jul. 22, 1997

[54] METHOD OF MASS PRODUCING PRINTED CIRCUIT ANTENNAS

[75] Inventors: Ross W. Lampe, Raleigh, N.C.; Claes Henri von Shéele, Sandby, Sweden

[73] Assignee: Ericsson Inc., Research Triangle Park, N.C.

[21] Appl. No.: 544,631

[22] Filed: Oct. 18, 1995

[51] Int. Cl.[6] ..... H01R 11/00

[52] U.S. Cl. ..... 29/600; 343/806

[58] Field of Search ..... 29/600, 846, 411, 29/412; 343/806, 895

[56] References Cited

U.S. PATENT DOCUMENTS

| | | | |
|---|---|---|---|
| 4,356,492 | 10/1982 | Kaloi | 343/700 MS |
| 4,788,523 | 11/1988 | Robbins | 29/412 |
| 4,792,781 | 12/1988 | Takahashi et al. | 29/421 |
| 4,843,404 | 6/1989 | Benge et al. | 343/895 |
| 5,241,299 | 8/1993 | Appalucci et al. | 343/895 |

*Primary Examiner*—P. W. Echols
*Assistant Examiner*—Adrian L. Coley
*Attorney, Agent, or Firm*—Charles L. Moore

[57] ABSTRACT

A method of mass producing printed circuit antennas is disclosed including the steps of providing a substrate of dielectric material having a first side and a second side, removing portions of the substrate to produce an array of interconnected segments of desired size, fabricating a main radiating element on the first side of each substrate segment, overmolding each substrate segment with a protective dielectric material, and separating each substrate segment from the dielectric substrate to form a plurality of individual printed circuit antennas. Preferably, each of the foregoing steps are able to be performed on each substrate segment substantially simultaneously. The method may also include the steps of freeing one end of the substrate segments, attaching an electrical connector to each substrate segment, and overmolding the electrical connector for each of the substrate segments prior to the separating step. Fabrication of additional radiating elements to the first or second side, or alternatively a reactive or parasitic element to the second side, may be undertaken so that the printed circuit antennas are capable of multi-band operation.

33 Claims, 5 Drawing Sheets

METHOD OF MASS PRODUCING PRINTED CIRCUIT ANTENNAS

BACKGROUND OF THE INVENTION

1. Field of the Invention

The present invention relates to printed circuit antennas for radiating and receiving electromagnetic signals and, more particularly, to a method of mass producing such printed circuit antennas.

2. Description of Related Art

It has been found that a monopole antenna mounted perpendicularly to a conducting surface provides an antenna having good radiation characteristics, desirable drive point impedance, and relatively simple construction. As a consequence, monopole antennas have been utilized with portable radios, cellular telephones, and other personal communication systems. Until recently, however, such monopole antennas have been limited to wire designs (e.g., the helical configuration in U.S. Pat. No. 5,231,412 to Eberhardt et al.), which operate at a single frequency within an associated bandwidth.

In order to minimize size requirements and permit multi-band operation, while overcoming the disadvantages associated with microstrip and lamina antennas, the assignee of the present invention has recently filed several patent applications for printed circuit antennas, including Ser. No. 08/459,237 entitled "Printed Monopole Antenna," Ser. No. 08/459,235 entitled "Multiple Band Printed Monopole Antenna," and Ser. No. 08/459,553 entitled "Multiple Band Printed Monopole Antenna." It is highly desirable that such printed circuit antennas be mass produced or manufactured in such a way that costs are reduced and efficiency is increased. It is also desirable that the method of mass producing the printed circuit antennas maintain a high level of uniformity and quality.

In light of the foregoing, a primary object of the present invention is to provide a process for mass producing printed circuit antennas.

Another object of the present invention is to provide a process for mass producing printed circuit antennas which minimizes the time required to produce such printed circuit antennas.

A further object of the present invention is to provide a process for mass producing printed circuit antennas which enables one step thereof to be performed for all such printed circuit antennas substantially simultaneously.

Yet another object of the present invention is to provide a process for mass producing printed circuit antennas which enables more than one step thereof to be performed for all such printed circuit antennas substantially simultaneously.

Still another object of the present invention is to provide a process for mass producing printed circuit antennas which are able to operate within more than one frequency bandwidth.

These objects and other features of the present invention will become more readily apparent upon reference to the following description when taken in conjunction with the following drawing.

SUMMARY OF THE INVENTION

In accordance with the present invention, a method of mass producing printed circuit antennas is disclosed including the steps of providing a substrate of dielectric material having a first side and a second side, removing portions of the substrate to produce an array of interconnected segments of desired size, fabricating a main radiating element on the first side of each substrate segment, overmolding each substrate segment with a protective dielectric material, and separating each substrate segment from the dielectric substrate to form a plurality of individual printed circuit antennas. Preferably, each of the foregoing steps are able to be performed on each substrate segment substantially simultaneously.

In a second aspect of the present invention, the steps of freeing one end of the substrate segments, attaching an electrical connector to each substrate segment, and overmolding the electrical connectors prior to the separating step is included.

In a third aspect of the present invention, the fabrication of additional elements to the substrate segment takes place to permit multi-band operation by the printed circuit antenna. This includes the addition of at least one other radiating element on either the first or second side thereof, or alternatively a reactive element or parasitic element fabricated on the second side of each substrate segment, prior to the overmolding step.

In a fourth aspect of the present invention, the order of the steps for the method of the present invention are modified so that fabrication of a plurality of the main radiating elements on the first side of the dielectric substrate is performed first and then portions of the substrate are removed to produce an array of interconnected substrate segments which each include one of the main radiating elements.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1A:
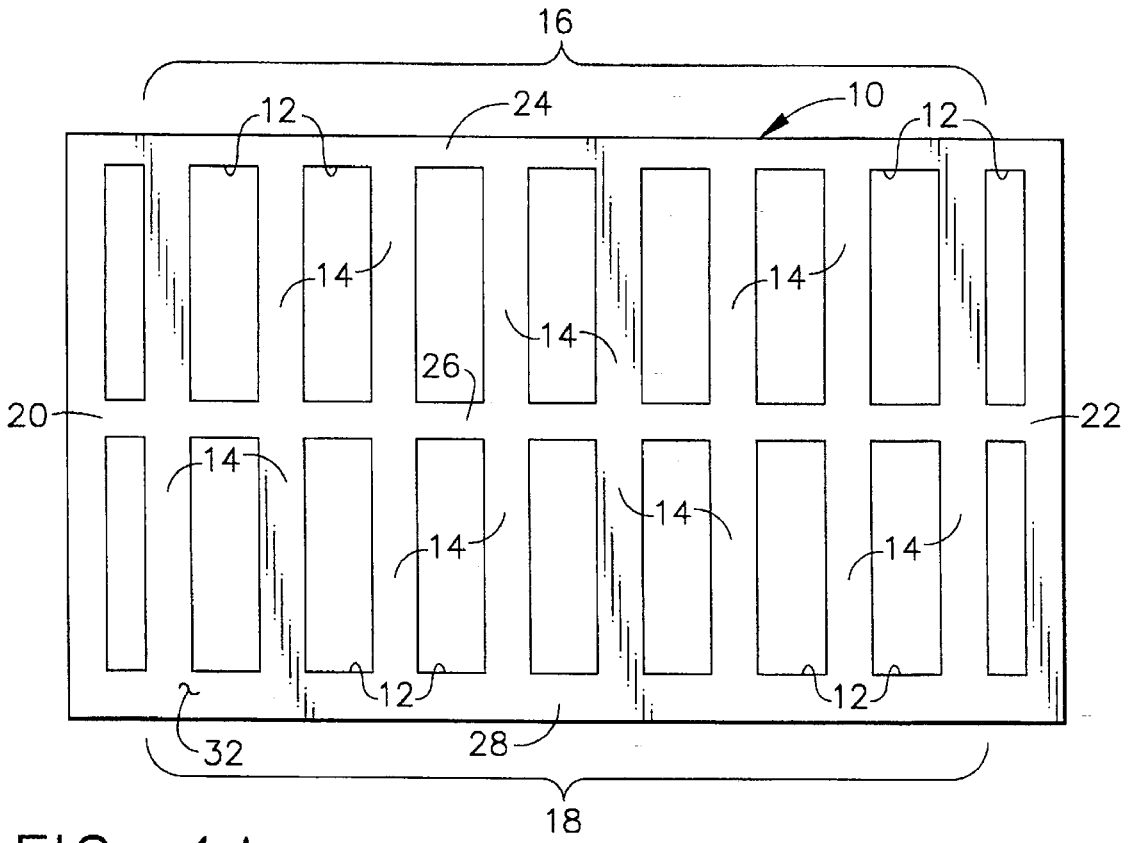
FIG. 1A is a schematic top view of a dielectric substrate with portions of the substrate removed to depict a plurality of interconnected substrate segments.

Referring now to the drawings in detail, wherein identical numerals indicate the same elements throughout the figures, FIG. 1A depicts a dielectric substrate identified generally by the numeral 10 in which portions of substrate 10 have been removed to form a plurality of open areas or cutouts 12 and a plurality of interconnected substrate segments 14. As will be seen therein, substrate segments 14 are arrayed in a pair of adjacent rows 16 and 18, although the arrangement of such substrate segments 14 may be in any desirable manner. In order for substrate segments 14 to remain interconnected throughout the process of the present invention, a pair of side portions 20 and 22 of dielectric substrate 10 remain, as does a top portion 24, a middle portion 26, and a bottom portion 28.

Figure 1B:
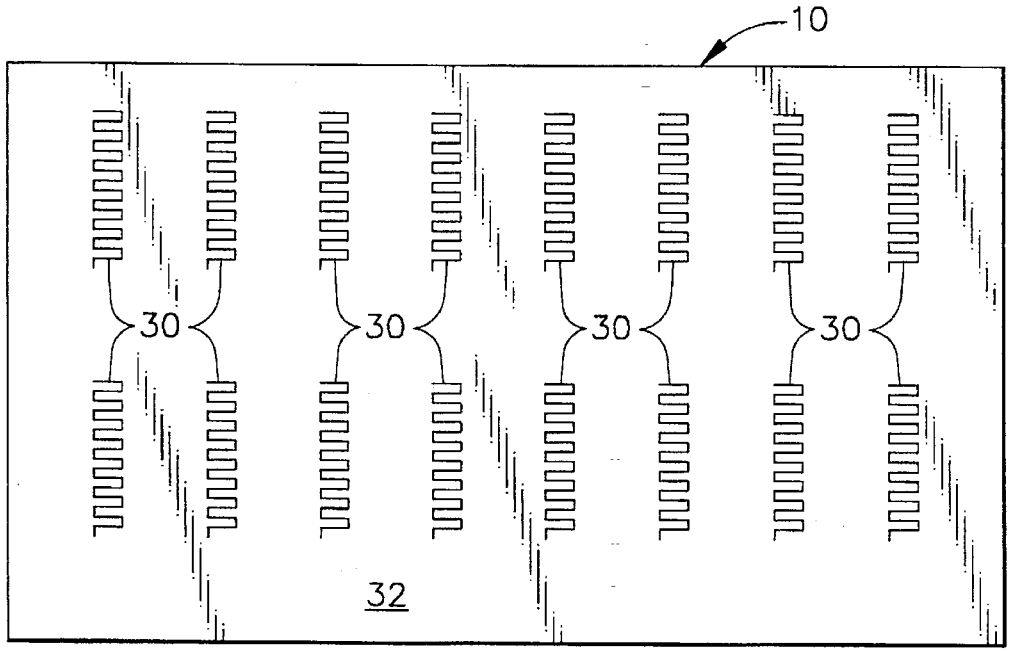
FIG. 1B is a schematic top view of a dielectric substrate with a plurality of radiating elements fabricated thereon in a predetermined pattern.

Instead of first forming the individual substrate segments 14 as shown in FIG. 1A, the method of mass producing printed circuit antennas may alternatively involve fabricating a plurality of main radiating elements 30 in a conductive material of desired size on dielectric substrate 10 in a predetermined pattern prior to forming individual substrate segments 14 as shown in FIG. 1B.

Figure 2:
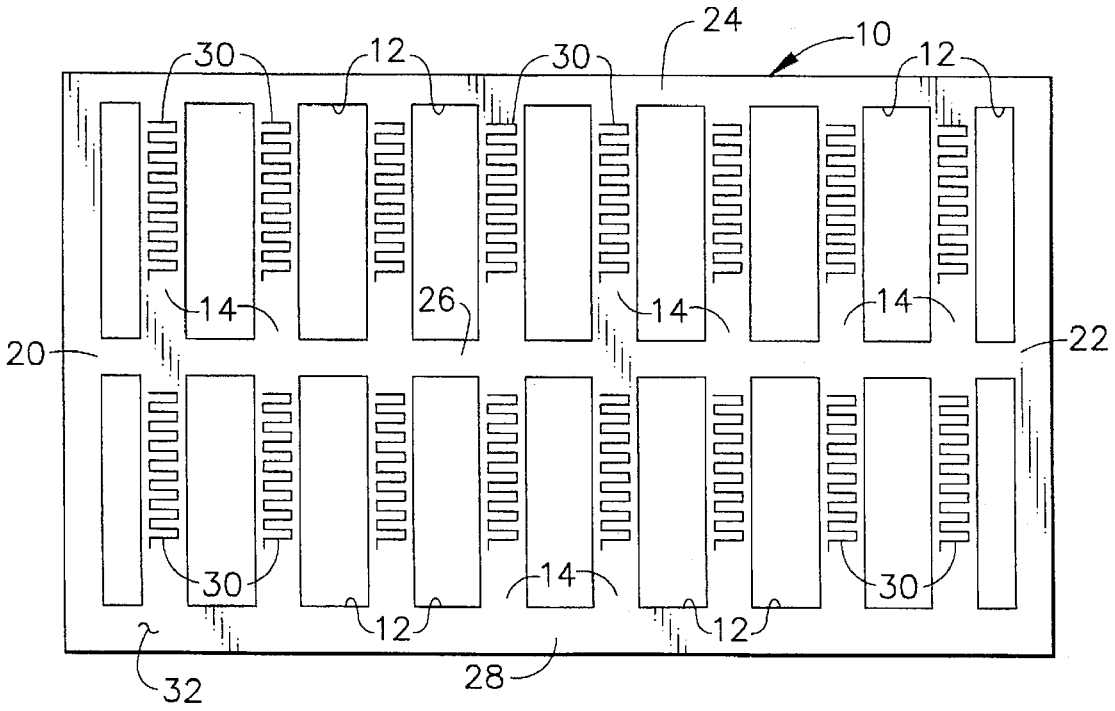
FIG. 2 is a schematic top view of the dielectric substrate of FIG. 1A in which a main radiating element has been fabricated on each substrate segment or a schematic top view of the dielectric substrate depicted in FIG. 1B in which portions of the substrate have been removed to form a plurality of interconnected substrate segments which each include a main radiating element previously formed on the dielectric substrate, respectively.

In either event, as seen in FIG. 2, substrate segments 14 each have a main radiating element 30 fabricated on a top side 32 thereof. This is accomplished by fabricating main radiating elements 30 onto substrate segments 14 when beginning with the dielectric substrate shown in FIG. 1A or removing portions of dielectric substrate 10 to form substrate segments 14 which include a main radiating element 30 when beginning with the dielectric substrate depicted in FIG. 1B. While it is preferred that each substrate segment 14 be initially sized to closely approximate the size of main radiating element 30, an optional trimming step for each substrate segment 14 may take place if necessary.

Figure 3:
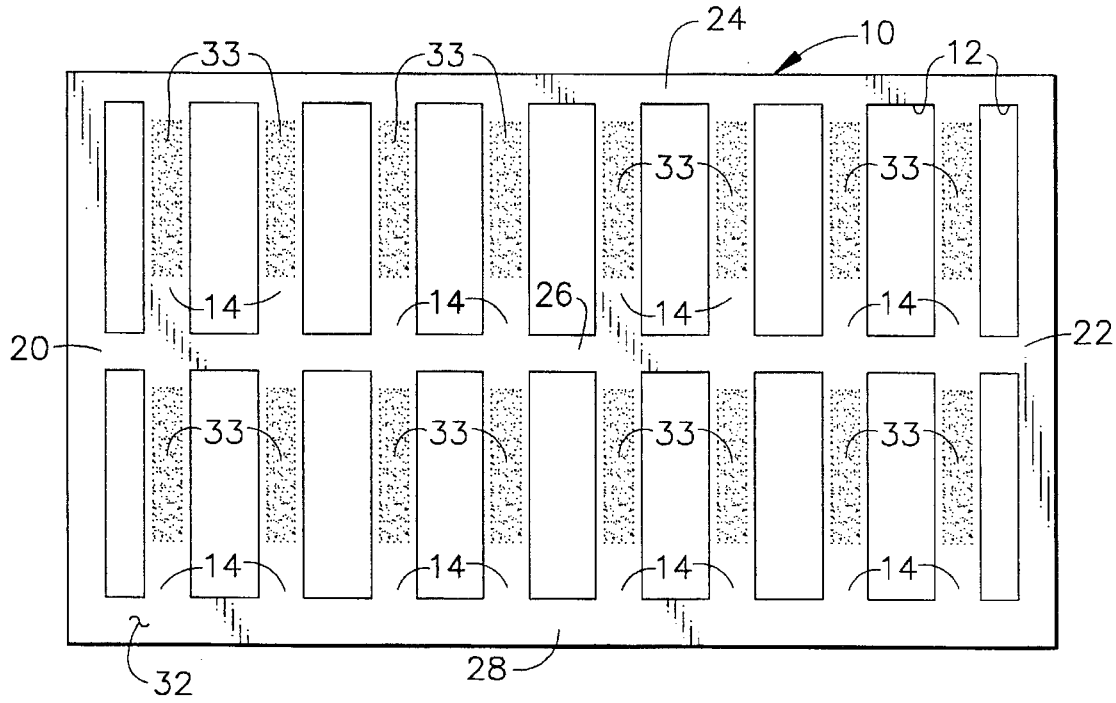
FIG. 3 is a schematic top view of the dielectric substrate of FIG. 2 with the top side of the substrate segments being overmolded.
Figure 4:
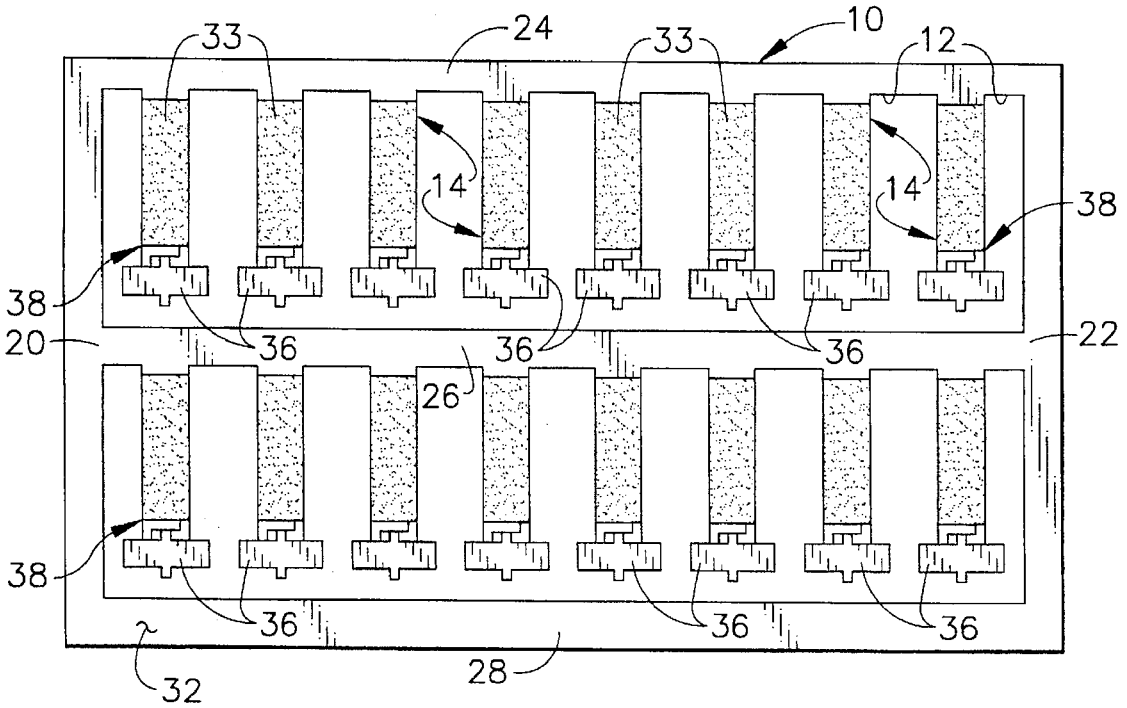
FIG. 4 is a schematic top view of the dielectric substrate depicted in FIG. 3 in which an electrical connector has been attached to each substrate segment.
Figure 5:
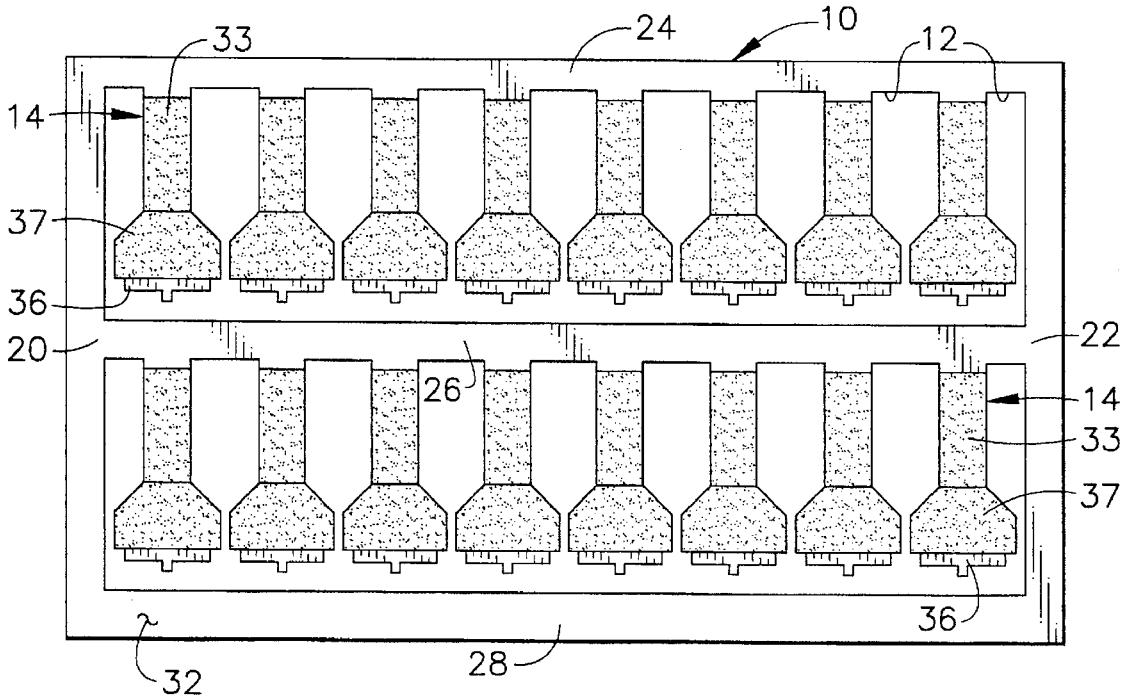
FIG. 5 is a schematic top view of the dielectric substrate of FIG. 4 in which the electrical connectors have been overmolded.

Thereafter, as depicted in FIG. 3, it is preferred that each substrate segment 14 be overmolded with a protective dielectric material (indicated by the numeral 33), preferably in a substantially simultaneous fashion. This may be accomplished by placing dielectric substrate 10 in an appropriate injection molding machine so the overmolding is applied as desired.

Figure 6:
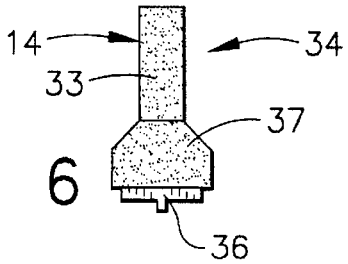
FIG. 6 is a schematic top side view of an individual printed circuit antenna after being separated from the dielectric substrate depicted in FIG. 5.

Once the overmolding of substrate segments 14 has been performed, each substrate segment 14 is then separated from dielectric substrate 10 (i.e., from top and middle portions 24 and 26, respectively), as applicable, to become an individual printed circuit antenna 34 as depicted in FIG. 6.

It will be noted that it is preferred that each of the foregoing steps in the process (i.e., forming the plurality of substrate segments 14, fabricating main radiating elements 30 on each substrate segment 14, overmolding each substrate segment 14, and separating each substrate segment 14 from dielectric substrate 10) will preferably occur substantially simultaneously for each substrate segment 14. In this way, the method of the present invention saves time and thereby increases efficiency. Likewise, it is preferred that the steps of forming each substrate segment 14 and fabricating main radiating elements 30 thereon, while shown as being separate steps in FIGS. 1A and 1B, occur substantially simultaneously.

Optionally, the method of the present invention may include the steps of freeing one end of substrate segments 14 and attaching an electrical connector 36 (e.g., a coaxial connector) to free end 38 of each substrate segment 14 prior to separation from dielectric substrate 10. For example, electrical connector 36 may be attached to each substrate segment 14 by means of a soldering or gluing process. Afterward, it would be preferred for electrical connectors 36 to also be given an overmolding layer 37 for each substrate segment 14, with the overmolding of all such electrical connectors 36 occurring substantially simultaneously.

It will be understood from the previously identified related patent applications that dielectric substrate 10 is preferably made of a dielectric material, such as polyamide, polyester, or the like, having a minimum degree of flexibility. This not only meets the requirements of the end environment for printed circuit antennas 34, but also assists during production by providing some degree of tolerance within the environment of the machinery utilized.

It will further be understood that main radiating element 30 is preferably a printed trace of conductive material such as copper or conductive ink. Main radiating element 30 will normally have a non-linear configuration in which its electrical length is greater than its physical length to minimize its size, as explained in greater detail in a patent application having Ser. No. 08/459,959 entitled "Antenna Having Electrical Length Greater Than Its Physical Length," which is also owned by the assignee of the present invention and is hereby incorporated by reference.

Figure 7:
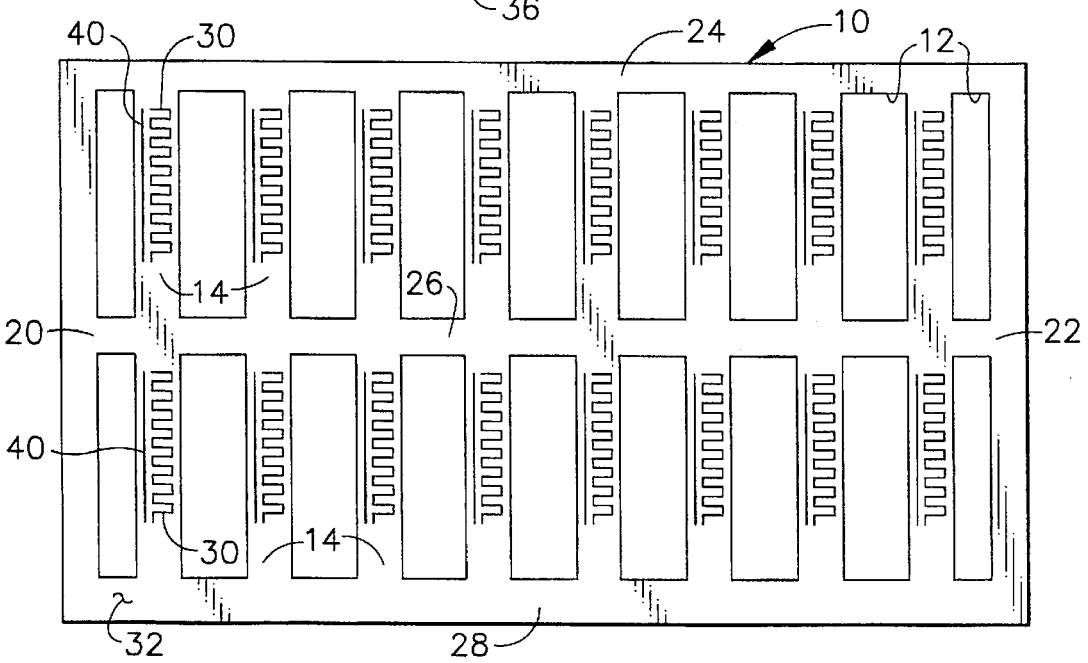
FIG. 7 is a schematic top side view of the dielectric substrate depicted in FIG. 2, wherein an additional radiating element has been fabricated on each substrate segment.
Figure 8:
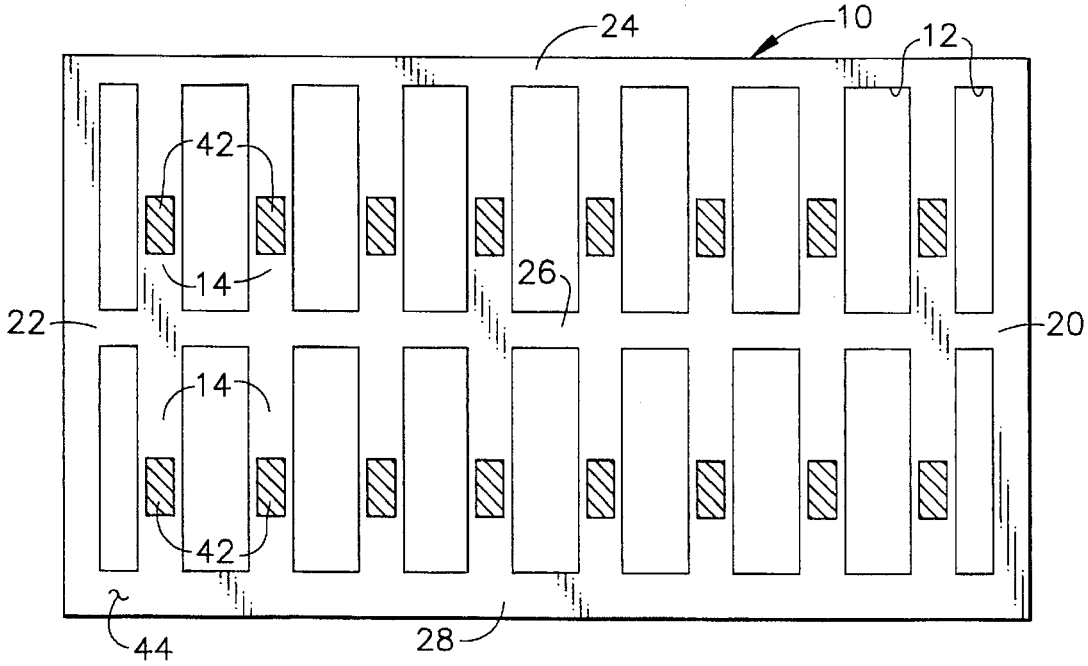
FIG. 8 is a schematic bottom side view of the dielectric substrate depicted in FIG. 2, wherein a reactive element has been fabricated on each substrate segment.

As described in greater detail in a patent application having Ser. No. 08/459,553 entitled "Multiple Band Printed Monopole Antenna," which is also owned by the assignee of the present invention and hereby incorporated by reference, at least one additional radiating element 40 may be positioned on top side 32 of each substrate segment 14. While radiating element 40 is shown as being linear, it may have any desired configuration. Additional radiating element 40 preferably is fabricated adjacent main radiating element 30 prior to overmolding of substrate segments 14. In this way, the individual printed circuit antenna 34 depicted in FIG. 7 may be utilized within multiple bandwidths. Of course, it is preferred that any additional radiating elements 40 be fabricated on each substrate segment 14 substantially simultaneously. Optimally, main radiating elements 30 and additional radiating elements 40 would be fabricated on each substrate segment 14 substantially simultaneously.

Figure 9:
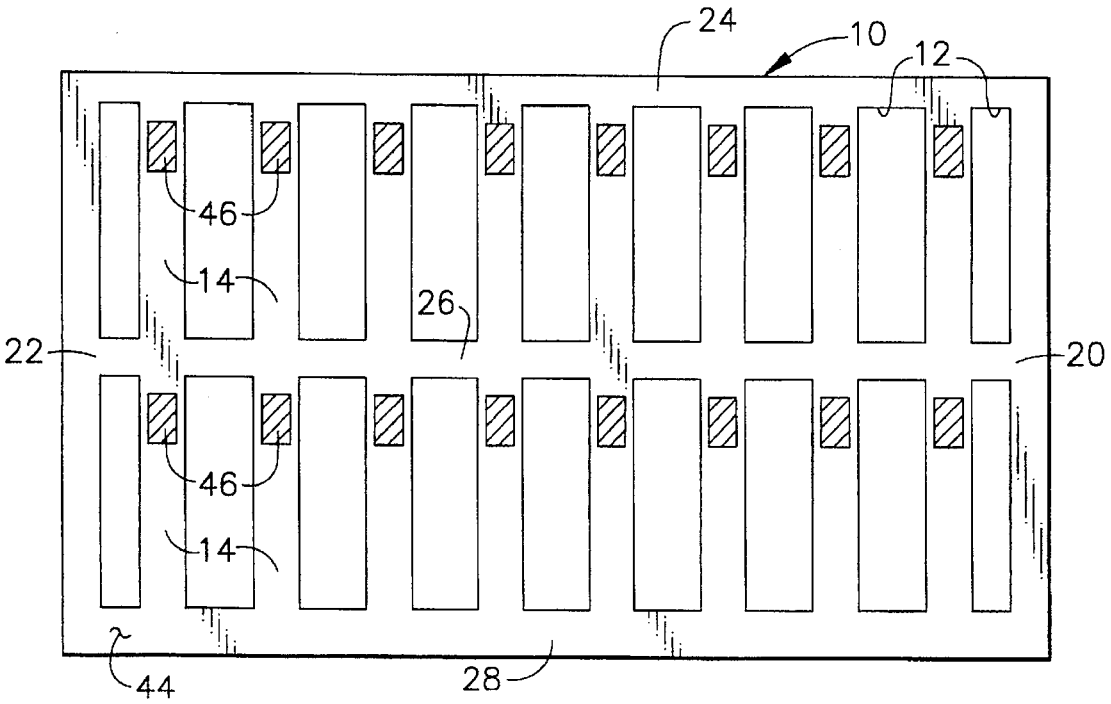
FIG. 9 is a schematic bottom side view of the dielectric substrate depicted in FIG. 2, wherein a parasitic element has been formed on each substrate segment.
Figure 10:
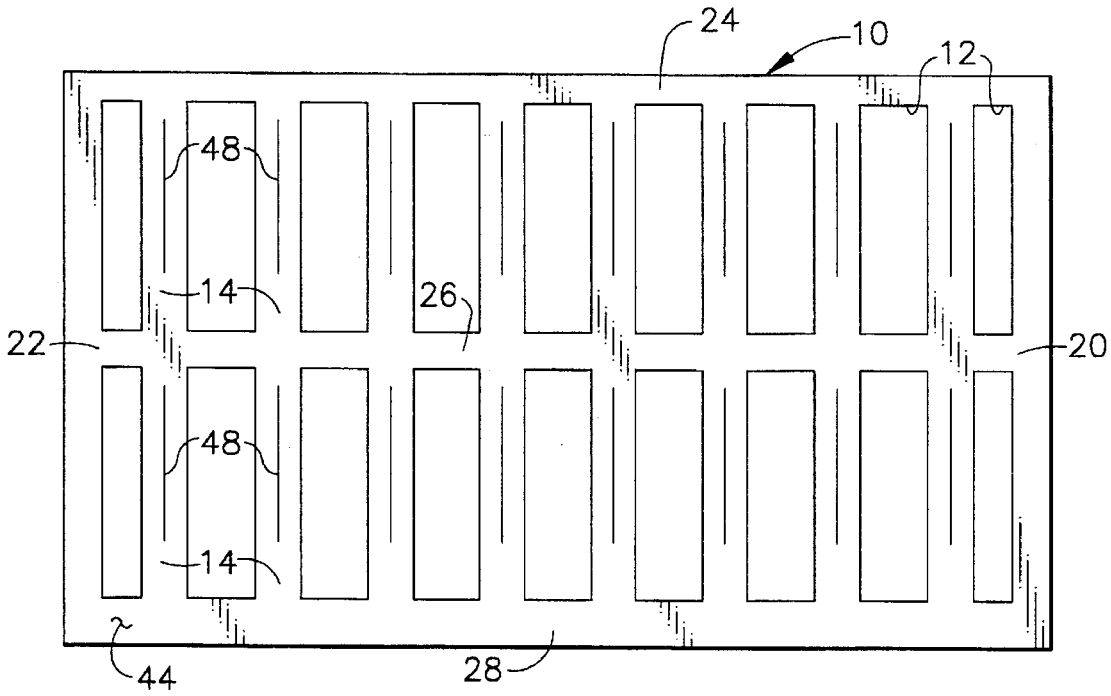
FIG. 10 is a schematic bottom side view of the dielectric substrate depicted in FIG. 2, wherein a second radiating element has been fabricated on each substrate segment.

Other alternative steps which may be taken to permit printed circuit antennas 34 to operate within multiple bandwidths include fabricating a reactive element 42 on a bottom side 44 of each substrate segment 14 (preferably adjacent free end 38), forming a parasitic element 46 on bottom side 42 of each substrate segment 14 (preferably opposite free end 38 as shown in FIG. 9), or fabricating a second radiating element 48 on bottom side 42 of each substrate segment 14 (as shown in FIG. 10). In each case, it will be understood that it is preferred that all reactive elements 40, parasitic elements 44, or second radiating elements 46 be fabricated or formed substantially simultaneously for each substrate segment 14. Of course, the addition of such elements should take place before substrate segment 14 is overmolded. In this way, printed circuit antennas 34 would take the form of one of the antennas described in patent applications having Ser.

Nos. 08/459,235 and 08/459,553, each entitled "Multiple Band Printed Monopole Antenna," which are also owned by the assignee of the present invention and hereby incorporated by reference.

Having shown and described the preferred embodiments of the present invention, further adaptations of the method for mass producing printed circuit antennas disclosed herein can be accomplished by appropriate modifications by one of ordinary skill in the art without departing from the scope of the invention. In particular, while main radiating element 30 herein has been shown and described as a monopole, it can easily be a dipole by properly configuring the conductive traces therefor. Also, as previously stated herein, the arrangement or configuration of substrate segments 14 in dielectric substrate 10 prior to separation may be in any given form and need not be limited to the pair of rows depicted herein.

What is claimed is:

1. A method of mass producing printed circuit monopole antennas, comprising the following steps:

(a) providing a substrate of dielectric material having a first side and a second side, wherein said substrate has a layer of conductive material on at least said first side;

(b) removing portions of said substrate to produce an array of interconnected segments having a desired size;

(c) fabricating a main radiating element on said first side of each substrate segment by removing a portion of said conductive material layer, said main radiating element being configured to have linear polarization;

(d) overmolding each substrate segment with a protective dielectric material; and (e) separating each substrate segment from said dielectric substrate to form a plurality of individual printed circuit antennas.

2. The method of claim 1, wherein the fabrication of said main radiating element on each substrate segment occurs substantially simultaneously.

3. The method of claim 1, wherein the removal of substrate portions to produce said array of interconnected segments occurs substantially simultaneously.

4. The method of claim 1, wherein said substrate removing step and said fabricating step occur substantially simultaneously.

5. The method of claim 1, wherein the overmolding of each substrate segment occurs substantially simultaneously.

6. The method of claim 1, wherein the separation of each substrate segment from said dielectric substrate occurs substantially simultaneously.

7. The method of claim 1, wherein said substrate is made of a dielectric material having at least a minimum degree of flexibility.

8. The method of claim 1, further comprising the steps of freeing one end of each substrate segment and attaching an electrical connector to the free end of each said substrate segment prior to said separating step.

9. The method of claim 8, further comprising the step of overmolding said electrical connector for each said substrate segment prior to said separating step.

10. The method of claim 9, wherein the overmolding of said electrical connector for each substrate segment occurs substantially simultaneously.

11. The method of claim 1, wherein said overmolding step is accomplished by injection molding.

12. The method of claim 1, further comprising the step of removing surplus substrate material prior to overmolding said substrate segments, wherein said substrate segments are the approximate size of said main radiating elements.

13. The method of claim 1, wherein said array comprises at least one row of a plurality of interconnected substrate segments.

14. The method of claim 1, wherein said main radiating element is a printed trace of conductive material.

15. The method of claim 1, wherein said fabricating step occurs prior to said substrate removing step.

16. The method of claim 15, wherein each of said substrate segments includes one of said main radiating elements thereon.

17. The method of claim 1, further comprising the step of fabricating at least one additional radiating element on said first side of each substrate segment.

18. The method of claim 17, wherein the fabrication of said additional radiating element on each substrate segment occurs substantially simultaneously.

19. The method of claim 17, wherein the fabrication of said main radiating element and said additional radiating element on each substrate segment occurs substantially simultaneously.

20. The method of claim 1, wherein said substrate has a layer of conductive material on said second side, further comprising the step of fabricating a reactive element on said second side of each said substrate segment by removing a portion of said conductive material layer.

21. The method of claim 20, wherein the fabrication of said reactive element on each substrate segment occurs substantially simultaneously.

22. The method of claim 1, wherein said substrate has a layer of conductive material on said second side, further comprising the step of forming a parasitic element on said second side of each said substrate segment by removing a portion of said conductive material layer.

23. The method of claim 22, wherein the forming of said parasitic element on each substrate segment occurs substantially simultaneously.

24. The method of claim 1, wherein said substrate has a layer of conductive material on said second side, further comprising the step of fabricating a second radiating element on said second side of each said substrate segment by removing a portion of said conductive material layer.

25. The method of claim 24, wherein the fabrication of said second radiating element on each substrate segment occurs substantially simultaneously.

26. A method of mass producing printed circuit monopole antennas, comprising the following steps:

(a) providing a substrate of dielectric material having a first side and a second side, wherein said substrate has a layer of conductive material on at least said first side;

(b) simultaneously fabricating a plurality of main radiating elements having a specified size on said first side of said dielectric substrate in a predetermined pattern by removing a portion of said conductive material layer, each of said main radiating elements being configured to have linear polarization;

(c) simultaneously removing portions of said dielectric substrate to produce an array of interconnected segments of desired size, each of said substrate segments including one of said main radiating elements;

(d) simultaneously overmolding each substrate segment with a protective dielectric material; and (e) simultaneously separating each said substrate segment from said dielectric substrate to form a plurality of individual printed circuit monopole antennas.

27. The method of claim 26, wherein said substrate is made of a dielectric material having at least a minimum degree of flexibility.

28. The method of claim 26, further comprising the steps of freeing one end of each substrate segment and attaching an electrical connector to the free end of each said substrate segment prior to said separating step.

29. The method of claim 28, further comprising the step of overmolding said electrical connector for each said substrate segment prior to said separating step.

30. The method of claim 26, further comprising the step of simultaneously fabricating at least one additional radiating element on said first side of each substrate segment.

31. The method of claim 26, wherein said substrate has a layer of conductive material on said second side, further comprising the step of simultaneously fabricating a reactive element on said second side of each said substrate segment by removing a portion of said conductive material layer.

32. The method of claim 26, wherein said substrate has a layer of conductive material on said second side, further comprising the step of simultaneously forming a parasitic element on said second side of each said substrate segment by removing a portion of said conductive material layer.

33. The method of claim 26, wherein said substrate has a layer of conductive material on said second side, further comprising the step of simultaneously fabricating a second radiating element on said second side of each substrate segment by removing a portion of said conductive material layer.

* * * * *